US008051819B2

(12) United States Patent
Kuribara et al.

(10) Patent No.: US 8,051,819 B2
(45) Date of Patent: Nov. 8, 2011

(54) CRANKCASE STRUCTURE FOR AN OVERHEAD-CAMSHAFT INTERNAL COMBUSTION ENGINE, AND ENGINE INCORPORATING SAME

(75) Inventors: Hiroshi Kuribara, Saitama (JP); Shinichiro Keyaki, Saitama (JP); Toru Nishi, Saitama (JP); Kazuaki Iino, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 489 days.

(21) Appl. No.: 12/380,482

(22) Filed: Feb. 27, 2009

(65) Prior Publication Data

US 2009/0241892 A1 Oct. 1, 2009

(30) Foreign Application Priority Data

Mar. 31, 2008 (JP) ..... 2008-094134

(51) Int. Cl.
*F01L 1/02* (2006.01)

(52) U.S. Cl. ..... 123/90.31; 123/195 C

(58) Field of Classification Search ..... 123/90.31, 123/195 C, 195 R
See application file for complete search history.

(56) References Cited

U.S. PATENT DOCUMENTS

2004/0149250 A1* 8/2004 Gschwindt et al. ..... 123/195 C

FOREIGN PATENT DOCUMENTS

JP 2006-105132 4/2006

* cited by examiner

*Primary Examiner* — Zelalem Eshete
(74) *Attorney, Agent, or Firm* — Carrier Blackman & Associates, P.C.; Joseph P. Carrier; William D. Blackman

(57) ABSTRACT

An overhead-camshaft internal combustion engine having an outer wall of a crankcase provided adjacent a crankshaft, with a spiral-surfaced opening through which the crankshaft is passed. The outer crankcase wall is integrally provided with a loop guide engaging recess formed thereon. The loop guide engaging recess supports a base end portion of a loop guide for guiding an endless chain. A loop-retaining member for preventing the timing endless chain from dropping is arranged at a position on the lower side of a loop drive sprocket integrally formed at an end portion of the crankshaft.

20 Claims, 6 Drawing Sheets

CRANKCASE STRUCTURE FOR AN OVERHEAD-CAMSHAFT INTERNAL COMBUSTION ENGINE, AND ENGINE INCORPORATING SAME

CROSS-REFERENCE TO RELATED APPLICATIONS

The present invention claims priority under 35 USC 119 based on Japanese patent application No. 2008-094134, filed on Mar. 31, 2008. The entire subject matter of this priority document, including specification claims and drawings, is incorporated by reference herein.

BACKGROUND OF THE INVENTION

1. Field of the Invention

The present invention relates to a crankcase structure for an over head camshaft (OHC) type of internal combustion engine. More particularly, the present invention relates to a crankcase structure having a loop guide locking (engaging) recess and a loop-retaining member integrally formed on a crankcase of the OHC internal combustion engine.

2. Description of the Background Art

There is a known OHC internal combustion engine in which a loop guide engaging recess is formed at an outer periphery of a crankshaft-penetrated opening in a crankcase of the internal combustion engine, the crankshaft-penetrated opening and an opening in the vicinity of the loop guide engaging recess are each formed in a tumbler-like shape deformed from a circular shape, and a loop-retaining member for preventing an endless loop member from dropping from an intake and exhaust valve-driving sprocket at the times of maintenance, inspection or repair is formed in a plate provided as a body separate from the crankcase.

An example of such known OHC internal combustion engine in which a loop guide engaging recess is formed at the outer periphery of a crankshaft-penetrated opening in a crankcase of the internal combustion engine is disclosed in the Japanese Patent Laid-Open No. 2006-105132.

In the OHC internal combustion engine, as disclosed in the Japanese Patent Laid-Open No. 2006-105132, the plate as a body separate from the crankcase as well as the loop-retaining member is needed separately, whereby the number of component parts is increased.

In addition, an inner peripheral surface of an opening formed in a crankcase overlaps partially with a hollow cylindrical surface having a smaller radius, while the inner peripheral surface of the opening on the side remote from the crankshaft overlaps with a hollow cylindrical surface having a larger radius, to be in a tumbler-like shape. Therefore, stress concentration occurs in a constricted portion (a waist portion). In order to avoid this problem, the crankcase wall is made thicker, leading necessarily to undesirable increase in weight.

The present invention has been made to overcome such drawbacks. Accordingly, it is one of the objects of the present invention to provide a crankcase structure for an OHC internal combustion engine which has a small number of component parts, is simple in structure, and is light in weight.

SUMMARY OF THE INVENTION

In order to achieve the above objects, the present invention according to a first aspect thereof provides a crankcase structure for an OHC internal combustion engine having an endless chain by which a loop drive sprocket integral with a crankshaft is connected with an intake and exhaust valve-driving sprocket for opening and closing intake and exhaust valves; a crankcase having a bearing member for rotatably supporting the crankshaft, the crankcase being provided in its outer wall with an opening through which the crankshaft is passed, near the extension of the center line of the crankshaft, an outer wall surface of the crankcase being integrally provided with a loop guide-engaging recess by which a base end portion of a loop guide for guiding the endless chain is engagedly supported; and a loop-retaining member located on the lower side of the loop drive sprocket and operable to prevent the timing endless chain from dropping.

The present invention according to the first aspect is characterized in that, when viewed in side view, an inner peripheral surface of an opening of the crankcase is formed as a spiral surface such that a diameter thereof increases along the direction reverse to the rotational direction of the crankshaft; the spiral surface having a starting end between a vertical plane passing through the center of the crankshaft and directed downwards, and a horizontal plane passing through the center of the crankshaft and being on the side of the rotational direction of the crankshaft; a maximum-radial end of the spiral surface being terminated by a surface which intersects a surface passing through the center of the crankshaft and through the starting end; the loop-retaining member is integrally provided projectingly outwards from the outer wall surface of the crankcase along the circumferential direction of the loop drive sprocket; and the loop guide-engaging recess is disposed on a plane which is substantially orthogonal to the extension of a cylinder center line and which passes through the center line of the crankshaft.

The present invention according a second aspect, in addition to the first aspect, is characterized in that a portion of circumferential crankcase outer wall ranging from the loop guide-engaging recess to the loop-retaining member in the surroundings of the opening of the crankcase is thicker than the other circumferential portions of crankcase outer wall.

The present invention according to third aspect, in addition to the second aspect, is characterized in that the OHC internal combustion engine is mounted on a vehicle, a cylinder of the internal combustion engine is inclined toward the vehicle front side, and the loop guide-engaging recess is disposed on the front side relative to the crankshaft.

EFFECTS OF THE INVENTION

An ordinary internal combustion engine is rarely operated in the condition where the cylinder(s) is directed down or skewly down. In the present invention according to the first aspect therefore, the extremely highly stiff loop guide-engaging recess disposed at a position on a surface passing through the center of the crankshaft and substantially orthogonal to the cylinder center line is not adjacent to that minimum-radius starting end of the opening surface of the crankcase at which stress concentration is liable to occur. Therefore, such configuration makes it possible to avoid stress concentration in the vicinity of the loop guide-engaging recess which is extremely high in stiffness.

In addition, the loop-retaining member is located in the vicinity of a position just under the crankshaft, and is adjacent to the small-radius starting end of the inner peripheral surface of the opening of the crankcase. Therefore, the loop-retaining member for preventing the dropping of the timing endless chain wrapped around the loop drive sprocket fitted over the crankshaft protruding from the opening can be brought close to the loop drive sprocket. Accordingly, the dropping of the chain can be prevented securely.

Further, of the inner peripheral surface of the opening of the crankcase, the portion ranging from the loop guide-engaging recess to the terminal end part of the inner peripheral surface of the opening is enlarged in diameter. Therefore, the crankcase can be made lighter in weight.

In the present invention according to the second aspect, the extremely highly stiff loop guide-engaging recess which is often disposed at a position on a surface passing through the center of the crankshaft where a high stress is generated by the pressure of the combustion gas in the internal combustion engine and being substantially orthogonal to the cylinder center line and on which a high load is exerted and the loop-retaining member which has high strength and stiffness are connected to each other through a thick wall. Therefore, stress is dispersed, and stress concentration is inhibited more assuredly.

In the present invention according to the third aspect, the cylinder(s) is inclined in a forward direction. As a result, the loop guide-engaging recess and the loop-retaining member can be set further closer to each other, whereby the effect obtained according to the second aspect of the present invention, as discussed above, can be augmented.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF ILLUSTRATIVE EMBODIMENTS

An embodiment of the present invention will now be described, with reference to the drawings. Throughout this description, relative terms like "upper", "lower", "above", "below", "front", "back", and the like are used in reference to a vantage point of an operator of the vehicle, seated on the driver's seat and facing forward. It should be understood that these terms are used for purposes of illustration, and are not intended to limit the invention.

Now, an illustrative embodiment of the present invention is described below with reference to FIGS. 1 to 7.

Figure 1:
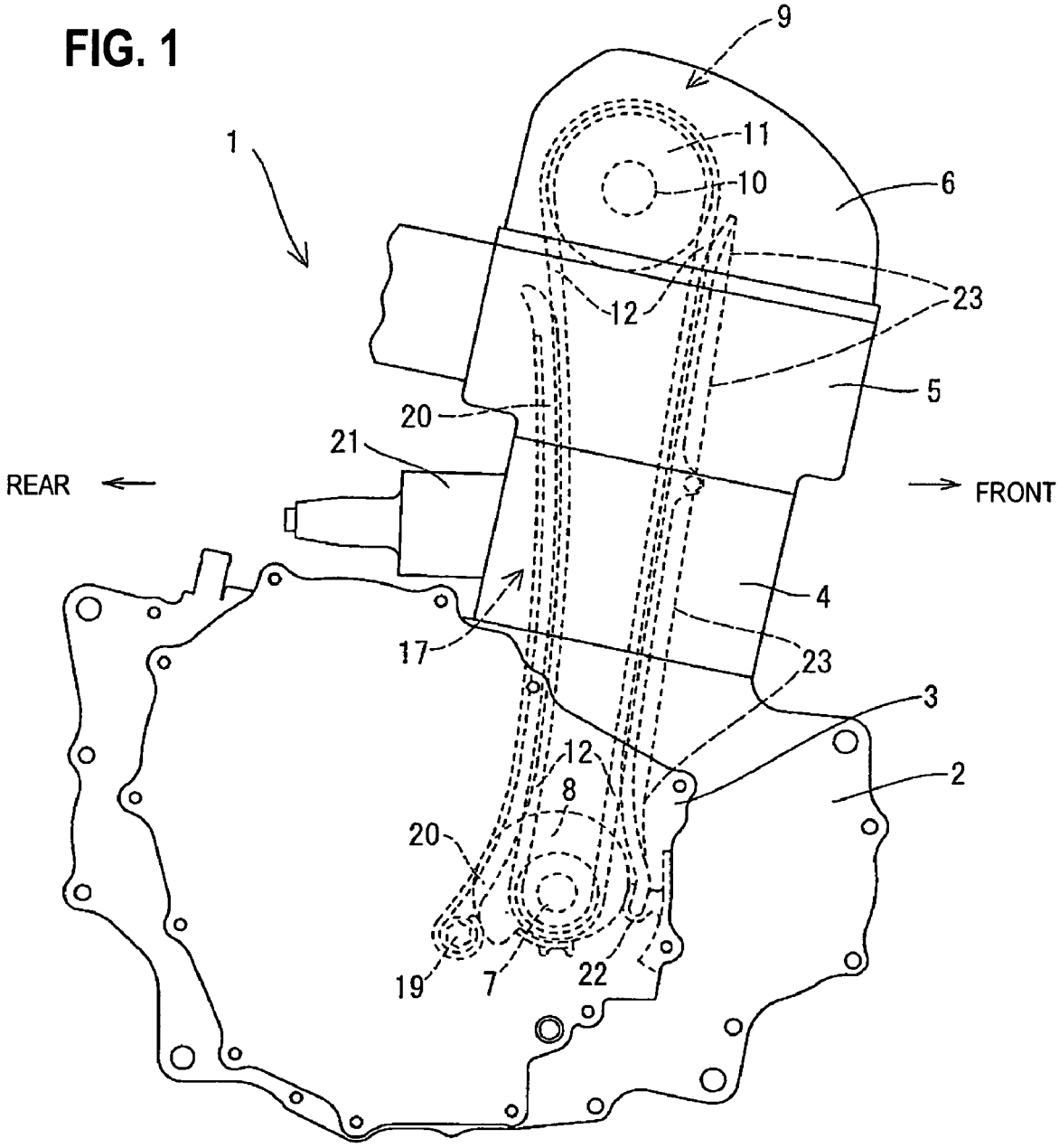
FIG. 1 is a right side view of an OHC internal combustion engine having a crankcase structure according to the present invention.

An OHC internal combustion engine 1 shown in FIG. 1 is a 4-stroke-cycle single-cylinder internal combustion engine mounted on a motorcycle (not shown). The engine 1 may be a multi-cylinder internal combustion engine. The OHC internal combustion engine 1 includes a left-right split type crankcase (in FIG. 1, only a right crankcase 2 is shown) and a crankcase cover detachably attached to an outside surface of the left-right split type crankcase. While only a right crankcase cover 3 is shown in FIG. 1, a left crankcase cover is attached to a left crankcase (not shown).

The OHC internal combustion engine 1 further includes a cylinder block 4, a cylinder head 5, and a cylinder head cover 6 which are integrally and sequentially attached on the upper side of the left-right split type crankcase 2. The cylinder block 4, the cylinder head 5 and the cylinder head cover 6 are mounted on the motorcycle in a manner of being slightly inclined toward a vehicle front side from an upright state.

As shown in FIG. 1, in the left-right split type crankcase, a crankshaft 7 is oriented in a vehicle width direction and operable to rotate in a clockwise direction, and a loop drive sprocket 8 (which may be a gear) is integrally provided at an end portion of the crankshaft 7 which protrudes rightwardly from the right crankcase 2. A valve mechanism 9 for driving intake and exhaust valves (not shown) in intake and exhaust ports (not shown) of the cylinder head 5 to open and close is provided at the cylinder head 5 inside the cylinder head cover 6. An intake and exhaust valve-driving sprocket 11 having a number of teeth is integrally provided at a right end of a camshaft 10 of the valve mechanism 9. The number of teeth provided on the intake and exhaust valve-driving sprocket 11 is twice the number of teeth of the loop drive sprocket 8.

Further, a timing endless chain 12 (which may be a toothed belt) is wrapped around the loop drive sprocket 8 and the intake and exhaust valve-driving sprocket 11 so that the intake and exhaust valves are driven to open and close in conjunction with the operation of the crankshaft 7.

Figure 3:
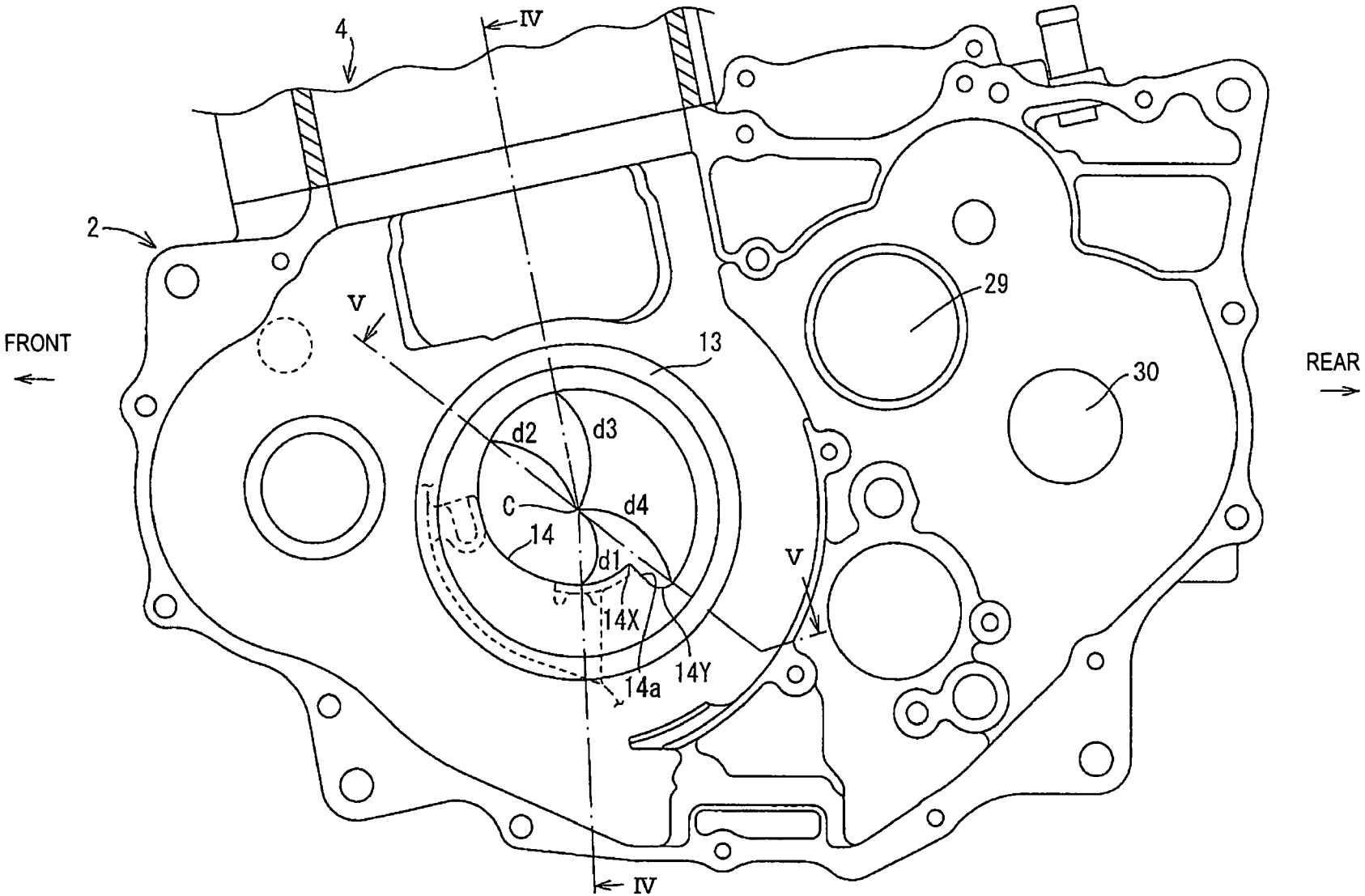
FIG. 3 is a left side view of a left crankcase in the illustrative embodiment of the present invention.
Figure 4:
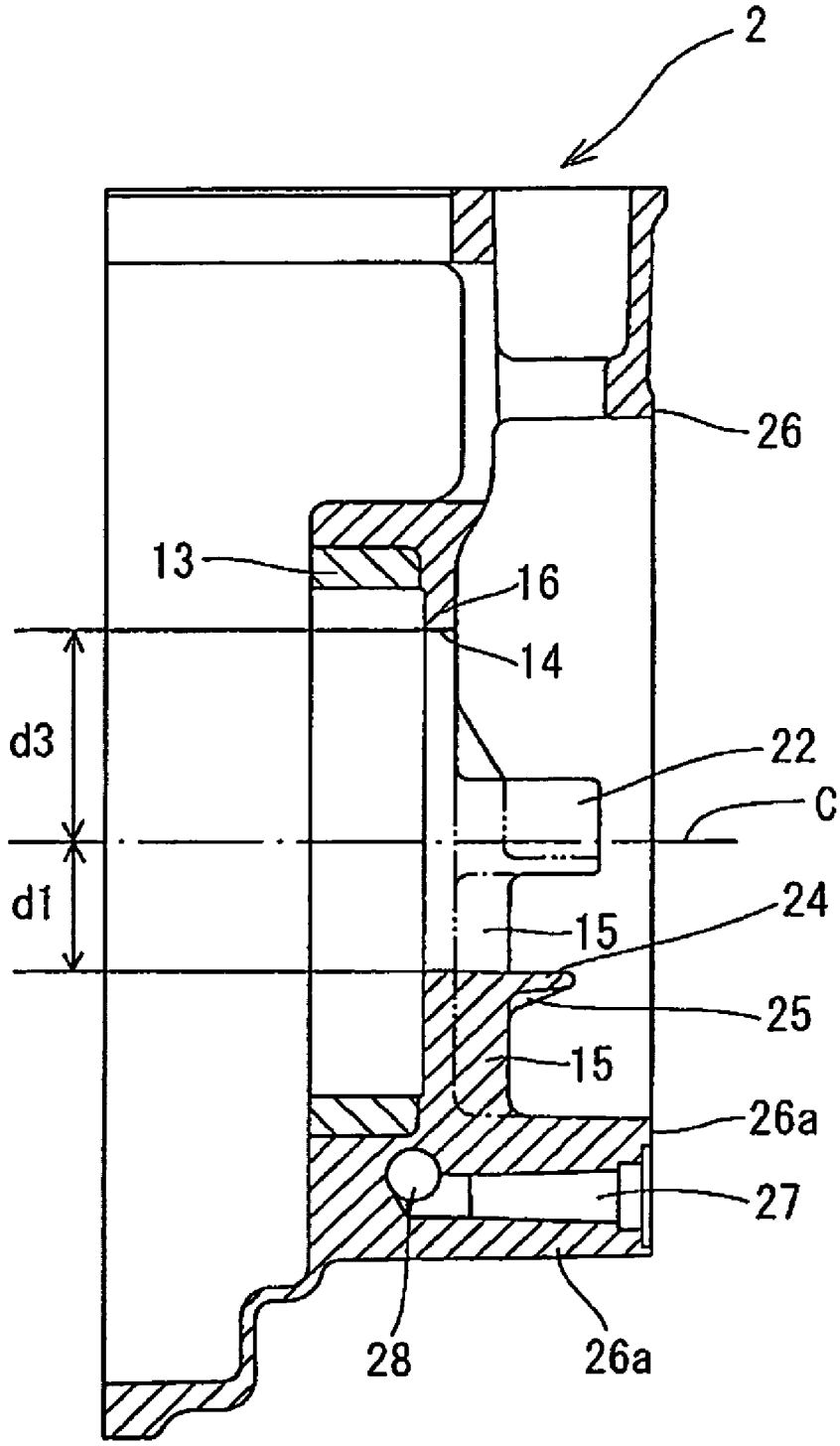
FIG. 4 is a longitudinal sectional view taken along line IV-IV of FIGS. 2 and 3.
Figure 5:
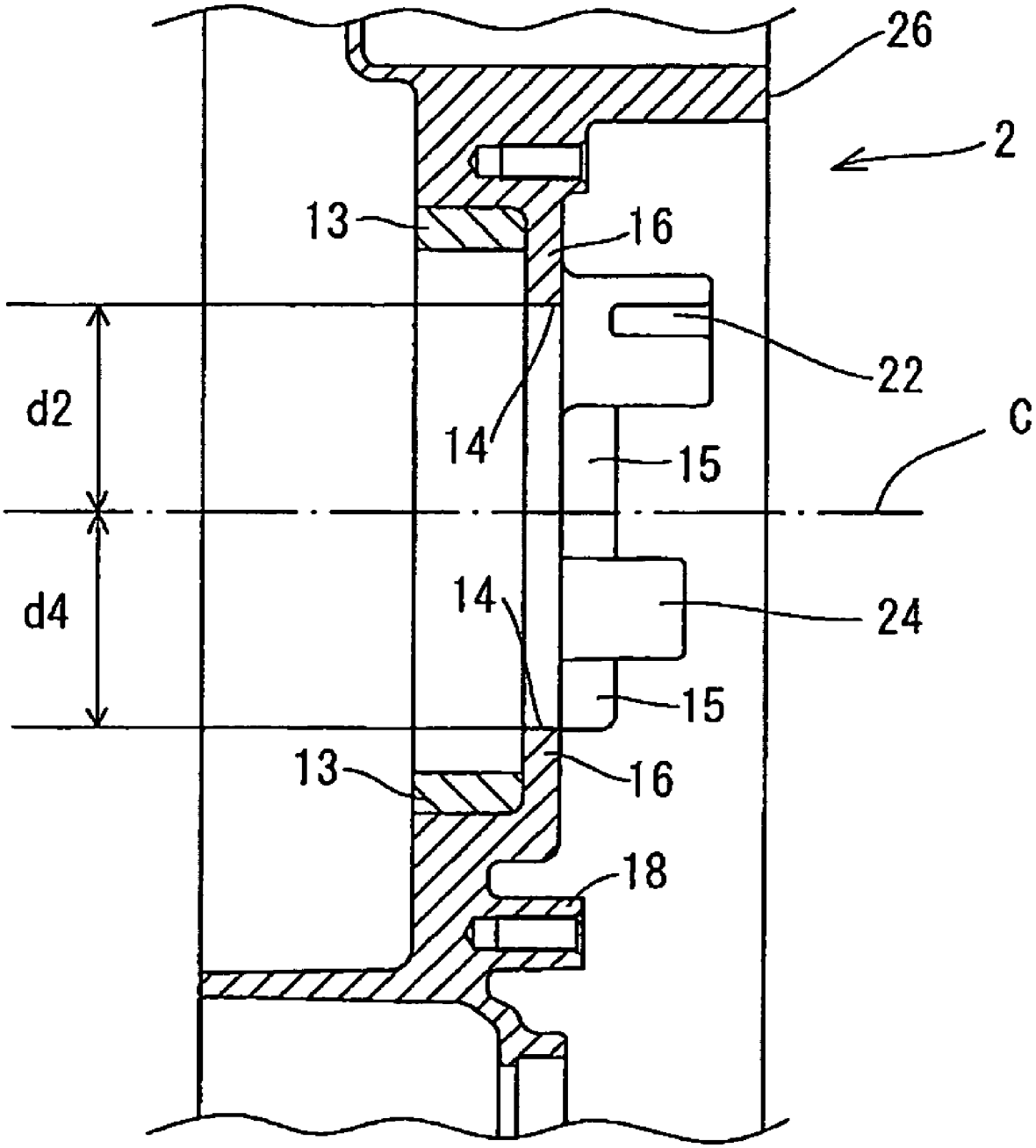
FIG. 5 is a longitudinal sectional view taken along line V-V of FIGS. 2 and 3.
Figure 6:
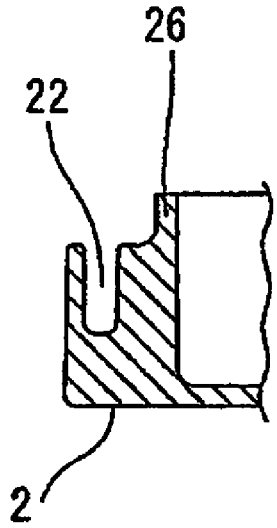
FIG. 6 is a longitudinal sectional view taken along line VI-VI of FIG. 2.
Figure 7:
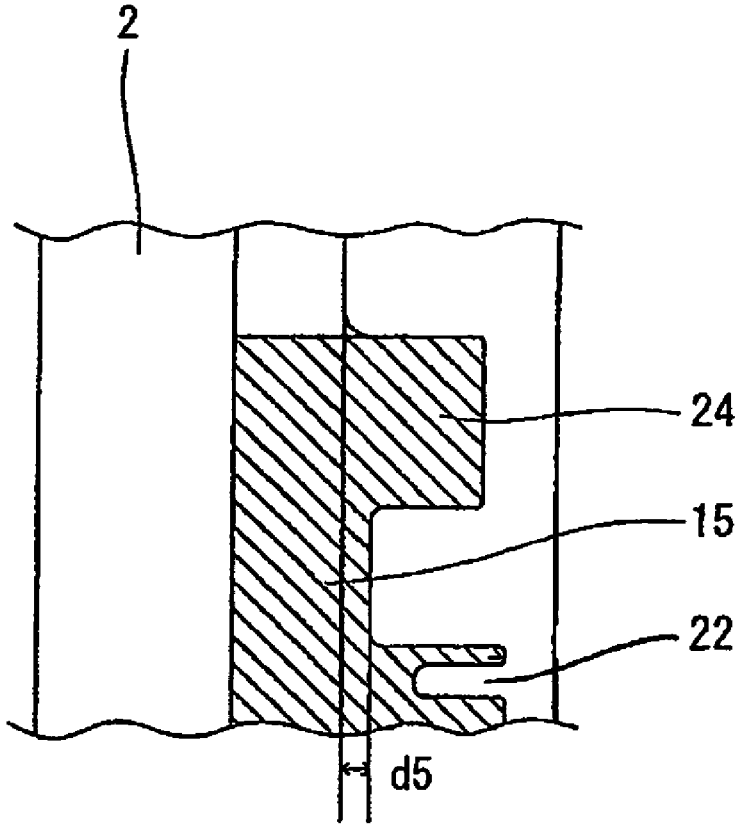
FIG. 7 is a longitudinal sectional view taken along line VII-VII of FIG. 2.

As shown in FIGS. 3 through 5, a reinforcement ring 13 in which a bearing (not shown) for the crankshaft 7 can be fit is integrally fitted in an inner wall surface of the crankcase 2. A spiral opening 14 (having a shape in which the increase in a radius of the spiral is not proportional to but is greater than an increase in the center angle, and which is also called a notilus-like shape) with the center of the reinforcement ring 13, i.e., the crankshaft center C, substantially as a center, is formed.

The inner peripheral surface of the spiral opening 14 has a starting end (small-radius portion 14X) between a vertical plane LV and a horizontal plane LH. The vertical plane LV passes through the crankshaft center C, and is directed downwards from the crankshaft center C. The horizontal plane LH passes through the crankshaft center C, and is on the side of the rotational direction of the crankshaft.

The spiral opening 14 is formed in a spiral shape such that the radius is increased from the starting end 14X along a direction reverse to a rotational direction of the crankshaft 7. The inner peripheral surface of the spiral opening 14 is shaped such that the maximum radius end thereof is disposed, and the spiral is terminated, on a surface intersecting an end face 14*a* passing through the crankshaft center C and through the starting end 14X.

The end face 14*a* connecting a maximum-radius portion 14Y and the small-radius portion 14X of the spiral opening 14 to each other is located at a position on a vehicle rear lower side of the crankshaft center C.

Figure 2:
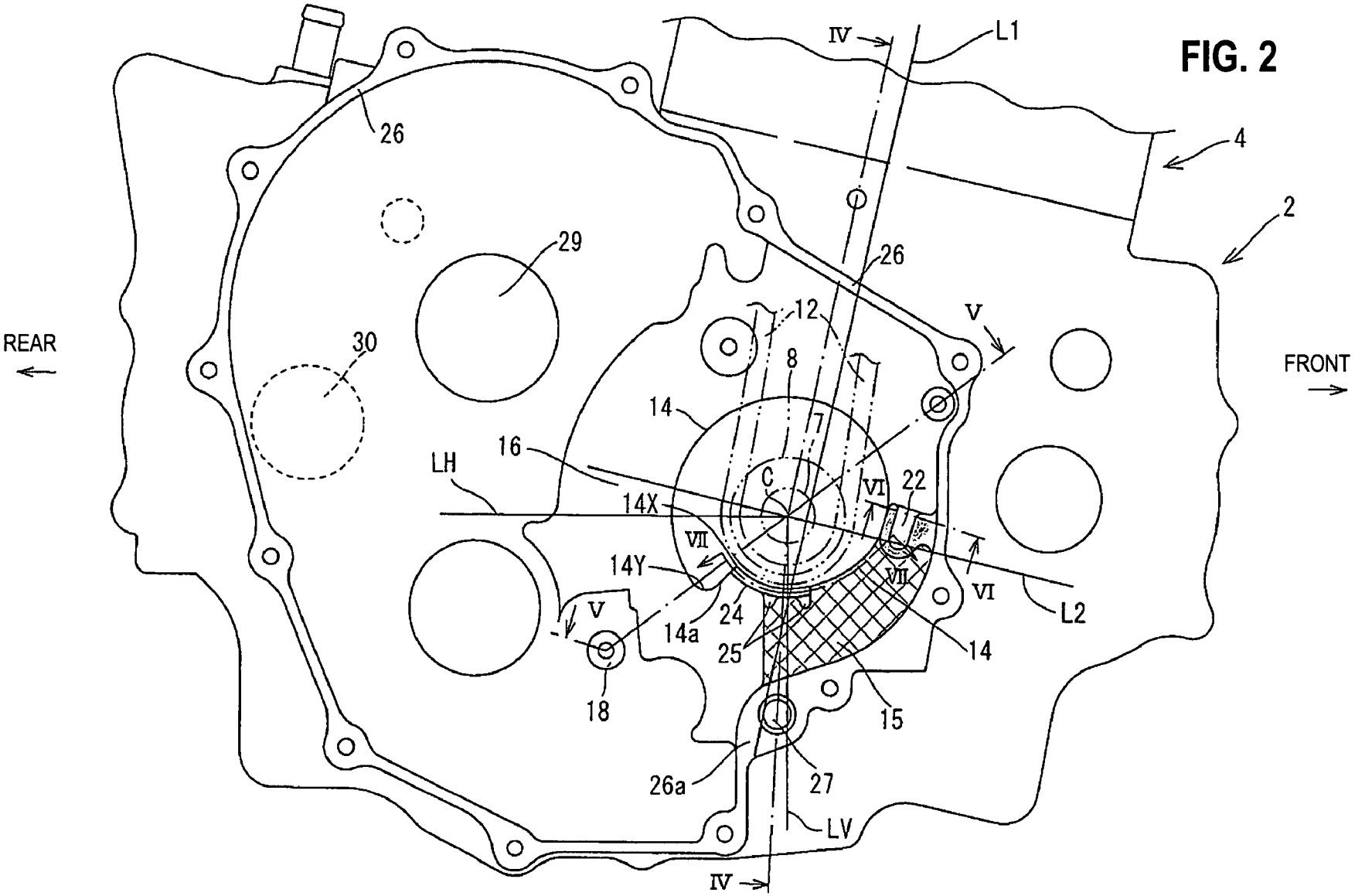
FIG. 2 is a right side view of a right crankcase in an illustrative embodiment of the present invention.

A reinforced portion 15 (shown by cross-hatched section in FIG. 2), where the spiral opening 14 is reinforced in a circumferential direction of the crankcase side wall in the vicinity of the spiral opening 14 of the crankcase 2 between a position substantially under the crankshaft center C shown in FIG. 2 and an upper end edge of a loop guide engaging recess (also referred as loop guide-engaging recess) 22, is formed to be thicker than the other circumferential portions 16 of the crankcase side wall in the vicinity of the spiral opening 14 of the crankcase 2.

Thus, the crankcase 2 is reinforced by the reinforced portion 15 so that it can sufficiently endure the force acting downwards from the crankshaft 7 during combustion in the combustion chamber. In addition, the thinning of the other circumferential potions 16 of the crankcase side wall of the crankcase 2 makes it possible to render the crankcase 2 being lighter in weight.

In FIGS. 2 and 3, let a radius of a lower portion of an intersection between a section line IV-IV passing through the crankshaft center C and the spiral opening 14 be d1, let a radius of an upper portion of the intersection be d3, let a radius of the upper portion of the intersection between a section line V-V and the spiral opening 14 be d2, and let a radius of the lower portion of the intersection be d4, then these radii are set in a relationship shown below.

$$d1<d2\leqq d3<d4$$

As shown in FIG. 1, in a space inside the right crankcase 2 and the crankcase cover 3 and in a space inside the cylinder block 4 and the cylinder head 5, a cam chain tensioner 17 is disposed on a rear side of and adjacent to the timing endless chain 12. As shown in FIGS. 1 and 2, the cam chain tensioner 17 includes a bolt 19 engaged with a projection 18 projecting rightwards from an outer wall surface of the right crankcase 2, a slipper 20 turnably supported on the bolt 19 so as to be swingable to the front and rear sides, and a hydraulic type tensioner lifter 21 disposed on the rear side of the cylinder block 4 and which presses the slipper 20 from the vehicle rear side toward the vehicle front side.

As shown in FIGS. 1 and 2, on the front side of and adjacent to the loop drive sprocket 8, the substantially U-shaped loop guide engaging recess 22, when viewed in side view, is integrally provided to project rightwardly from the outer wall surface of the right crankcase 2. As shown in FIGS. 4 and 5, and a lower end of a loop guide 23 is downwardly inserted into and engaged with the loop guide engaging recess 22.

Further, at a position on the lower side of the loop drive sprocket 8, a loop-retaining member 24 for preventing the loop drive sprocket 8 from dropping is integrally provided to project rightwardly from the outer wall surface of the right crankcase 2. As shown in FIG. 2, the loop-retaining member 24 is curved in an arc shape along the inner peripheral surface of the spiral opening 14 from the small-radius portion 14X of the spiral opening 14 toward the vehicle front side.

A substantially central portion of the loop-retaining member 24 in the arc direction is located at a boundary portion between the spiral opening 14 and the reinforced portion 15. Adjacent to the reinforced portion 15, the outer peripheral surface of the loop-retaining member 24 is provided with two reinforcement ribs 25 projecting in a radial direction from the crankshaft center C, at a predetermined interval along the circumferential direction.

As shown in FIGS. 2 and 4, of a contact flange 26 of the right crankcase 2 for contact with the crankcase cover 3, a portion 26*a* located on the lower side of the reinforcement ribs 25 of the loop-retaining member 24 is provided with an oil passage 27 extending from a mating surface for mating with the crankcase cover 3 toward the left side of the portion 26*a*, and further with an oil passage 28 (see FIG. 4) orthogonal to the oil passage 27. These oil passages 27, 28 constitute oil passages for supplying lubricating oil from an oil pump (not shown) to locations where the lubricating oil is needed.

The crankcase 2 is provided with bearing members 29, 30 and the like for turnably supporting a main shaft and a counter shaft of a transmission (not shown) disposed on rear side relative to a crank chamber located just under the cylinder block 4.

The embodiment shown in FIGS. 1 to 7 is configured as discussed above. The embodiment produces the following effects.

In the OHC internal combustion engine 1 shown in the FIGS. 1-7, due to the pressure of the combustion gas in the combustion chamber (not shown) between an upper portion of a cylinder bore in the cylinder block 4 and the cylinder head 5, a high impact downward load transmitted through a piston (not shown) and a connective rod (not shown) is exerted from the crankshaft 7 to the reinforcement ring 13 of the crankcase 2.

Accordingly, a stress in the direction for tearing up the crankcase 2 into upper and lower portions is generated at a portion where the plane L2 passing through the crankshaft center C and being orthogonal to the cylinder center line L1 intersects the inner peripheral surface of the spiral opening 14 of the crankcase 2 (a portion on the opposite side of the crankshaft center C from the portion where the loop guide engaging recess 22 is located).

The front-side portion of the inner peripheral surface of the spiral opening 14 of the crankcase 2 at which the loop guide engaging recess 22 is located is spaced by about 135° in terms of center angle from the small-radius portion 14X of the spiral opening 14. Therefore, the front-side portion has a large radius of curvature, the above-mentioned tearing stress in this part is not so high, and stress concentration there is obviated because of the presence of the loop guide engaging recess 22 which is high in stiffness.

Further, the rear-side portion of the inner peripheral surface of the spiral opening 14 of the crankcase 2 which is on the opposite side of the crankshaft center C from the front-side portion of the inner peripheral surface of the spiral opening 14 of the crankcase 2 has an enlarged radius. This ensures that the vertical tearing stress in the rear-side portion is low, so that the crankcase 2 can endure the vertical tearing stress even if its wall thickness is small.

Further, the loop-retaining member 24 is disposed adjacent to the small-radius portion 14X of the spiral opening 14 of the crankcase 2. As shown in FIG. 2, therefore, the loop-retaining member 24 can be set externally close to the loop drive sprocket 8 in the radial direction, whereby dropping of the timing endless chain 12 at the time of maintenance, inspection or repair can be prevented securely.

Furthermore, since the loop guide engaging recess 22 on which a high load is exerted and the loop-retaining member 24 which is high in stiffness are connected to each other through the reinforced portion 15 having a large wall thickness, a portion of the load on the loop guide engaging recess 22 can be borne also by the loop-retaining member 24 through the circumferential reinforced portion 15 of the case side wall. As a result, stress concentration in the vicinity of the loop guide engaging recess 22 can be obviated more assuredly.

Moreover, since the loop-retaining member 24 is reinforced with the two reinforcement ribs 25 projecting in the radial direction from the crankshaft 7, the loop-retaining member 24 is firmly connected to the reinforced portion 15 through the reinforced portion 15.

In addition, the case circumferential portion 16 other than the reinforced portion 15 between the loop guide engaging recess 22 and the loop-retaining member 24 is small in wall thickness, and the radius of the spiral opening 14 at this part is large. This makes it possible to render the crankcase 2 lighter in weight.

Further, the loop guide engaging recess 22 and the loop-retaining member 24 can be formed to be integral with the crankcase 2 by casting. Therefore, it is possible to reduce the number of component parts, to reduce the number of working steps, and to achieve a large reduction in cost.

Furthermore, although stress would easily be concentrated on a stepped portion between the reinforced portion 15 having a large wall thickness and the circumferential portion 16 having a small wall thickness, such stress concentration is inhibited, since the loop-retaining member 24 is integrally provided in the area ranging from the reinforced portion 15 to the circumferential portion 16 and the stepped portion between the reinforced portion 15 and the circumferential portion 16 is reinforced by the loop-retaining member 24.

Although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the scope of the claims, are intended to be within the scope and spirit of the present invention.

What is claimed is:

1. A crankcase structure for an overhead-camshaft internal combustion engine having an endless loop member which operatively connects a loop drive sprocket integral with a crankshaft having an intake and exhaust valve-driving sprocket thereon for driving intake and exhaust valves, said crankcase structure comprising:

a crankcase having a bearing member mounted thereon for rotatably supporting said crankshaft, said crankcase having a crankcase wall with a wall opening formed therein thereof for receiving an end portion of said crankshaft, an outer surface of said wall of said crankcase, proximate an extension of a center line of said crankshaft, having a loop guide-engaging recess formed thereon; said loop guide-engaging recess supporting a base end portion of a loop guide for guiding movement of said endless chain; and a loop-retaining member located on a lower side of said loop drive sprocket and operable to help retain said endless loop member on said sprocket;

wherein:

when viewed in a side view, an inner peripheral surface of said wall opening is formed as a spiral surface, such that a diameter of the opening increases along a direction reverse to a rotational direction of said crankshaft;

said spiral surface having a starting end between a vertical plane and a horizontal plane; said vertical plane passing through a center of said crankshaft and directed downwards; and said horizontal plane passing through the center of said crankshaft and being on a rotational direction side of said crankshaft, wherein a maximum-radial end of said spiral surface is terminated by a surface which intersects a surface passing through the center of said crankshaft and through said starting end;

said loop-retaining member is integrally provided projecting outwardly from said outer surface of said wall along a circumferential direction of said loop drive sprocket; and said loop guide-engaging recess is formed on a plane which is substantially orthogonal to the extension of a cylinder center line, and which passes through the center of said crankshaft.

2. The crankcase structure for an overhead-camshaft internal combustion engine as set forth in claim 1, wherein a circumferential portion of said crankcase wall ranging from said loop guide-engaging recess to said loop-retaining member surrounding said opening of said crankcase is thicker than other portions of said crankcase wall.

3. The crankcase structure for an overhead-camshaft internal combustion engine as set forth in claim 1, wherein said internal combustion engine is mounted in a vehicle;

a cylinder of said internal combustion engine is inclined toward a vehicle front side; and said loop guide-engaging recess is disposed on the front side relative to said crankshaft.

4. The crankcase structure for an overhead-camshaft internal combustion engine as set forth in claim 1, wherein said endless loop member comprises a toothed belt.

5. The crankcase structure for an overhead-camshaft internal combustion engine as set forth in claim 1, wherein when viewed in a side view, said loop guide-engaging recess has a substantially U-shaped profile.

6. The crankcase structure for an overhead-camshaft internal combustion engine as set forth in claim 1, wherein an outer peripheral surface of said loop-retaining member comprises a pair of reinforcement ribs, each of said reinforcement ribs projecting in a radial direction from the center of said crankshaft.

7. The crankcase structure for an overhead-camshaft internal combustion engine as set forth in claim 6, wherein the loop-retaining member has an oil passage formed therein.

8. The crankcase structure for an overhead-camshaft internal combustion engine as set forth in claim 1, wherein loop guide-engaging recess and the loop-retaining member are integrally formed with said crankcase by casting.

9. An internal combustion engine, comprising a crankcase;

a crankshaft rotatably supported by the crankcase;

a timing sprocket attached to an end portion of the crankshaft for concurrent rotation therewith;

an overhead camshaft;

a valve-driving sprocket attached to an end portion of the overhead camshaft;

an endless loop member operatively wrapped around said loop drive sprocket and said valve driving sprocket for operating intake and exhaust valves in conjunction with rotation of the crankshaft; and said crankcase having an opening formed in an wall thereof, said opening receiving an end portion of said crankshaft via a bearing member disposed in said opening;

an outer surface of said crankcase wall proximate an extension of a center line of said crankshaft having a loop guide engaging recess formed thereon;

a loop guide having a base end portion thereof supported by said loop guide engaging recess for guiding said endless loop member; and a loop-retaining member disposed on a lower side of said loop drive sprocket and operable to prevent said endless loop member from dropping;

wherein:

when viewed in a side view, a peripheral surface of said opening of said crankcase is formed as a spiral surface such that a diameter of the opening increases along a direction reverse to a rotational direction of said crankshaft;

said spiral surface has a starting end and a maximum-radial end; said starting end formed between a vertical plane and a horizontal plane; said vertical plane passing through a center of said crankshaft and being directed downwardly; and said horizontal plane passing through the center of said crankshaft and being on a side of the rotational direction of said crankshaft, said maximum-radial end of said spiral surface is terminated by a surface which intersects a surface passing through the center of said crankshaft and through said starting end;

said loop-retaining member is integrally provided projectingly outwards from said outer wall surface of said crankcase along the circumferential direction of said loop drive sprocket; and said loop guide engaging recess is formed on a plane which is substantially orthogonal to an extension of a center line of a cylinder of the engine, and which passes through the center of said crankshaft.

10. An internal combustion engine according to claim 9, wherein a circumferential portion of said crankcase wall ranging from said loop guide-engaging recess to said loop-retaining member in the surroundings of said opening of said crankcase is thicker than the other circumferential portions of said crankcase wall.

11. An internal combustion engine according to claim 9, wherein said overhead-camshaft internal combustion engine is mounted on a vehicle; said cylinder of said internal combustion engine is inclined toward a vehicle front side; and said loop guide-engaging recess is disposed on a front side relative to said crankshaft.

12. An internal combustion engine according to claim 9, wherein said endless loop member is a toothed belt.

13. An internal combustion engine according to claim 9, wherein when viewed in a side view, said loop guide engaging recess has a substantially U-shaped profile.

14. An internal combustion engine according to claim 9, wherein an outer peripheral surface of said loop-retaining member comprises a pair of reinforcement ribs, each of said reinforcement ribs projecting in a radial direction from the center of said crankshaft.

15. An internal combustion engine according to claim 9, wherein the loop guide engaging recess and the loop-retaining member are integrally formed with said crankcase by casting.

16. In combination an internal combustion engine and a crankcase structure for said internal combustion engine, said crankcase structure comprising:

a crankcase having an opening formed in an wall thereof, said opening receiving an end portion of a crankshaft via a bearing member disposed in said opening;

an outer surface of said crankcase wall in a vicinity of a center line of said crankshaft having a loop guide engaging recess formed thereon;

a loop guide having a base end portion thereof supported by said loop guide engaging recess for guiding an endless loop member operatively wrapped around a loop drive sprocket integrally formed on an end portion of the crankshaft and a valve driving sprocket for operating intake and exhaust valves in conjunction with rotation of the crankshaft; and a loop-retaining member disposed on a lower side of said loop drive sprocket and operable to prevent said endless loop member from dropping;

wherein:

when viewed in a side view, a peripheral surface of said opening of said crankcase is formed as a spiral surface such that a diameter of the opening increases along a direction reverse to a rotational direction of said crankshaft;

said spiral surface has a starting end and a maximum-radial end; said starting end formed between a vertical plane and a horizontal plane; said vertical plane passing through a center of said crankshaft and being directed downwards; and said horizontal plane passing through the center of said crankshaft and being on a side of the rotational direction of said crankshaft, said maximum-radial end of said spiral surface is terminated by a surface which intersects a surface passing through the center of said crankshaft and through said starting end;

said loop-retaining member is integrally provided projectingly outwards from said outer wall surface of said crankcase along the circumferential direction of said loop drive sprocket; and said loop guide engaging recess is formed on a plane which is substantially orthogonal to an extension of a center line of a cylinder of the engine, and which passes through the center of said crankshaft.

17. An internal combustion engine according to claim 16, wherein a circumferential portion of said crankcase wall ranging from said loop guide-engaging recess to said loop-retaining member in the surroundings of said opening of said crankcase is thicker than the other circumferential portions of said crankcase wall.

18. An internal combustion engine according to claim 16, wherein said internal combustion engine is mounted on a vehicle; said cylinder of said internal combustion engine is inclined toward a vehicle front side; and said loop guide-engaging recess is disposed on the front side relative to said crankshaft.

19. An internal combustion engine according to claim 16, wherein said endless loop member is a toothed belt.

20. An internal combustion engine according to claim 16, wherein when viewed in a side view, said loop guide engaging recess has a substantially U-shaped profile; and wherein said loop guide engaging recess and loop-retaining member are integrally formed with said crankcase by casting.

* * * * *